US005480712A

United States Patent [19]

Takahashi et al.

[11] Patent Number: 5,480,712

[45] Date of Patent: Jan. 2, 1996

[54] NON-HOLLOW ADSORBENT POROUS FIBER

[75] Inventors: Isamu Takahashi; Shigeki Hayashi; Yoshio Iida, all of Gifu, Japan

[73] Assignee: Ube-Nitto Kasei Co., Ltd., Tokyo, Japan

[21] Appl. No.: 852,259

[22] PCT Filed: Dec. 4, 1991

[86] PCT No.: PCT/JP91/01690

§ 371 Date: Jun. 3, 1992

§ 102(e) Date: Jun. 3, 1992

[30] Foreign Application Priority Data

| | | | |
|---|---|---|---|
| Oct. 31, 1991 | [JP] | Japan | 3-286715 |
| Oct. 31, 1991 | [JP] | Japan | 3-286716 |
| Oct. 31, 1991 | [JP] | Japan | 3-286717 |
| Oct. 31, 1991 | [JP] | Japan | 3-311309 |

[51] Int. Cl.[6] ..... B32B 3/26

[52] U.S. Cl. ..... 428/316.6; 428/315.5; 428/315.7; 428/35.7; 428/36.5

[58] Field of Search ..... 428/364, 400, 428/315.5, 35.7, 36.5, 315.7, 316.6, 372; 119/166; 73/40; 340/65

[56] References Cited

U.S. PATENT DOCUMENTS

| | | | |
|---|---|---|---|
| 3,665,068 | 5/1972 | Dublin et al. | 264/211 |
| 3,903,234 | 9/1975 | Ikeda et al. | 264/210 R |
| 4,413,110 | 11/1983 | Kauesh et al. | 526/348.1 |
| 4,429,993 | 12/1983 | South et al. | 264/210.8 |
| 4,430,383 | 2/1984 | Smith et al. | 428/364 |
| 4,612,148 | 9/1988 | Motooka et al. | 264/49 |
| 4,717,479 | 1/1988 | Itoh et al. | 210/490 |
| 4,770,852 | 9/1988 | Takahara et al. | 422/48 |
| 4,939,030 | 7/1990 | Tsuji et al. | 428/315.5 |
| 5,031,578 | 7/1991 | Hammon et al. | 119/167 |
| 5,102,590 | 4/1992 | Takahara et al. | 264/4 |
| 5,177,996 | 1/1993 | Sahakian | 73/40 |

FOREIGN PATENT DOCUMENTS

| | | |
|---|---|---|
| 59-18764 | 10/1984 | Japan . |
| 60-189420 | 9/1985 | Japan . |
| 62-191571 | 8/1987 | Japan . |
| 64-33276 | 2/1989 | Japan . |
| 1292169 | 11/1989 | Japan . |

*Primary Examiner*—Patrick J. Ryan
*Assistant Examiner*—Merrick Dixon
*Attorney, Agent, or Firm*—Nixon & Vanderhye

[57] ABSTRACT

A porous fiber having sufficient chemical resistance to a variety of substances to be adsorbed, and having a large specific surface area and a large void percentage. The porous fiber provided by the present invention features a main fiber body formed of a high-density polyethylene having a melt flow rate of 0.3 to 20 g/10 minutes and numerous pores. The pores are formed by mixing the high-density polyethylene with a paraffin wax while they are melted, melt-spinning a fiber with an extruder at a draft ratio of 200 or less, stretching the fiber, heat-treating the stretched fiber, mechanically crimping it and then removing the paraffin wax. In the porous fiber, the main fiber body has a specific surface area of 20 $m^2/g$ or more, the ratio of the pores to the main fiber body is 20% or more and the main fiber body has a size of not more than 50 denier.

5 Claims, 1 Drawing Sheet

X 3000

X 3000

X 10000

NON-HOLLOW ADSORBENT POROUS FIBER

TECHNICAL FIELD

The present invention relates to a porous fiber, particularly a porous fiber useful as an adsorbent and a reserve substrate, and a process for the production thereof.

TECHNICAL BACKGROUND

As a porous fiber, an acrylic porous fiber having voids formed during wet; spinning and a polyester-based porous fiber obtained by adding an elutable component, melt-spinning a fiber and then alkali-eluting the component are known, and there is further known a polyolefin-based hollow porous fiber having slit-like pores, produced by melt-spinning a polyolefin under high draft to obtain a hollow type fiber, heat-treating it to promote its crystallization and stretching it at a plurality of stages, as is described in Japanese Patent Publication No. 52123/1981.

However, the above acrylic porous fiber and polyester-based porous fiber, which are fibers having such a size as to be normally processable with a fiber machine such as a carding machine, have problems in that their void percentage, specific surface area, fiber surface opening ratio and pore diameter are all small due to their characteristics derived from the production process thereof and that, even if they are used as an adsorption material or a reserve substrate, they are therefore insufficient in adsorption amount and liquid retention amount and show a low adsorption rate and a low liquid absorption rate. Further, in terms of quality, they are corroded with an organic solvent and a strong alkali.

On the other hand, as far as the polyolefin-based hollow porous fiber is concerned, the chemical resistance is almost no problem, whereas it is difficult to obtain a fiber having a size of 50 denier or less which can be processed with a general fiber machine, and no polyolefin-based hollow porous fiber is commercially available. A fiber having a large size can be prepared into a fabric-like form only when its continuous filament is woven into a cloth. Meanwhile, an adsorbent having fine interstices like those of a nonwoven fabric is suitable as an adsorbent. However, a fiber having a large size can be formed only into a cloth, and a substance to be adsorbed passes through the cloth. Therefore, its adsorption efficiency is poor, and the adsorption performance which the fiber inherently has cannot be effectively used.

Further, in the porous fiber obtained by the production process described in Japanese Patent Publication No. 52123/1981, slender slit-like pores are dispersed on the fiber surface, and the pores are characteristically extending from the fiber surface toward its center nearly linearly in the cross section. For this reason, for example, even if an attempt is made to make a particulate substance adsorbed or sealed in, the above porous fiber cannot cope with particles having a larger particle diameter than the slit width. That is, in a substantial sense, the above porous fiber can be used only for adsorbing fine particles having a size of 0.1 μm or less.

Meanwhile, an attempt is being made to impart a fiber product with a deodorant function, and a number of processing methods therefor have been proposed. As typical examples of the processing methods of this type, there are known a method in which a porous substance having adsorption performance such as zeolite, activated carbon, silica gel, etc., is mixed with a synthetic resin material, the mixture is melt-spun to form a fiber and the fiber is stretched to expose the porous substance at the surface of the fiber, and a method in which a deodorant substance such as a porous substance is coated on the surface of a synthetic fiber produced by a general method. However, in the above method For producing a deodorant fiber by mixing a porous substance, the amount of the porous substance is increased to improve the deodorant function of the fiber. When the amount of the porous substance is increased, however, the fiber formability and stretchability decrease at the production step. As a result, the fiber that can be obtained is nothing but a fiber having a relatively large diameter. Moreover, since the internally embedded porous substance does not much contribute to the improvement in the deodorizing performance, the resultant fiber has too low deodorant performance for the amount of the added porous substance.

On the other hand, in the method in which the synthetic resin fiber is surface-coated with a deodorant substance, the improvement that can be expected in the deodorant performance is limited since the fiber surface area is limited. Further, there is another problem in that the deodorizing performance decreases since the deodorant substance drops off during the processing step.

The present invention has been made in view of these conventional problems. The object thereof is to provide a polyolefin porous fiber having such excellent chemical resistance as to be able to cope with a variety of substances to be adsorbed, having a large specific surface area and a large pore percentage, having a large surface opening ratio, and being processable with a general fiber machine, and a process for the production thereof.

DISCLOSURE OF THE INVENTION

The porous fiber of the present invention basically comprises a main fiber body formed of a polyolefin resin and numerous pores formed by mixing the above polyolefin resin with a paraffin wax, melt-spinning the resultant mixture to form a fiber, stretching the fiber, heat-treating it and then removing the paraffin wax.

The process for the production of the above porous fiber basically comprises mixing a predetermined amount of a polyolefin resin with a predetermined amount of paraffin wax while they are melted, melt-spinning the mixture at a predetermined draft ratio to obtain an unstretched fiber, then stretching the unstretched fiber under heat at a predetermined stretching ratio, heat-treating the stretched fiber, and removing the above paraffin wax to form a porous fiber.

And, as required, a deodorant substance, e.g., a plant extract oil such as a *Quercus stenophylla* extract, a wild thyme extract, or the like, or a surfactant is adsorbed on the internal surfaces of the pores.

The polyolefin resin that can be used in the present invention is preferably selected from polyethylene and polypropylene. When polyethylene is used, preferred is a high-density polyethylene having a melt flow rate (MFR) value, measured by a method according to ASTM D1238, of 0.3 to 20 g/10 minutes. As polypropylene, preferred is a polypropylene having a density of about 0.90 or more and an MFR value, measured by said measurement method, in the range of 0.5 to 9.0 g/10 minutes.

When the MFR values deviate from the above ranges, the melt viscosity is improper during the melt-spinning after the polyolefin resin is mixed with paraffin wax, and a problem arises in the spinning. The paraffin wax used in the present invention is composed mainly of a saturated aliphatic hydrocarbon compound, and preferred are those having a melting point of approximately 50° to 70° C. in view of easiness in their elutability with a solvent.

The above polyolefin resin and the above paraffin wax are mixed while melting them in such amounts that the proportion of the paraffin wax per 100 parts by weight of the polyolefin resin is 30 to 300 parts by weight, and the melt is used as a raw material for the spinning, whereby a favorable result can be obtained. The melt-spinning temperature is determined depending upon the melt-viscosity of the above mixed raw material. As a melt-spinning machine, it is preferred to use a screw-type extruder in order to promote the mixing and kneading of the polyolefin resin and the paraffin wax. The draft during the melt-spinning, i.e., the ratio of the take-up rate of the unstretched fiber to the linear velocity of the spinning from the spinning nozzle, is required to be not more than 400 in the case of the polypropylene and not more than 200 in the case of a high-density polyethylene.

When the drafts exceed these values, the crystallite size of the polypropylene or polyethylene decreases. And, the pore diameter of the resultant porous fiber is too small, and the void percentage thereof is also low. The unstretched fiber obtained under the above conditions is then stretched. Concerning the stretching conditions, the strain rate in the range of 60° to 120° C., i.e., a value defined by the following equation is required to be set at not more than 400%/minute.

$$\text{Strain rate (\%/minute)}=(GT-GF)/b\times 100$$

wherein the feed roller rate is GF (m/minute), the stretching side roller rate is GT (m/minute) and the distance between these rollers is L (m).

When the strain rate exceeds 400%/minute, tile pore diameter of the resultant porous fiber is nonuniform, and there occur considerably many places where pores are collapsed. When the stretching temperature is outside the above range, that is, when it is less than 60° C., the stretching is cold stretching, and the shrinkage ratio after the paraffin wax extraction is large to decrease the void percentage. Further, when it exceeds 120° C., the unstretched fiber is too soft to be stretched effectively, and the fiber strength decreases. The stretch ratio is preferably in the range of 1.4 to 4.5 times. When the stretch ratio is less than 1.4 times, the void percentage is low. When it exceeds 4.5 times, the pores are brought into a collapsed state due to the stretching.

The above-stretched fiber is subsequently subjected to heat treatment. This heat treatment is carried out to prevent a substantial decrease in the void percentage which is to be caused by the shrinkage of the fiber in the diameter and length directions after the paraffin wax has been extracted from the fiber with a solvent. The heat treatment temperature is preferably around the above stretching temperature or higher. The extraction of the paraffin wax is preferably carried out with a hydrocarbon solvent such as hexane, heptane, etc., in view of handling and low toxicity.

In the fiber of the present invention, obtained by the above production process, the void percentage based on the main fiber body is limited to 20% or more, and the specific surface area of the fiber itself is limited to 20 $m^2/g$ or more. The reason therefor is that when the void percentage is less than 20%, the fiber is insufficient as a reserve substrate for holding an active component. Further, when the specific surface area of the main fiber body is less than 20 $m^2/g$, the adsorption amount is small when a liquid or gaseous substance to be adsorbed or a substance to be adsorbed in a solution is adsorbed, and such a fiber is unsuitable as an adsorption material.

Further, the reason for limitation of the weight denier of the main fiber body to not more than 50 denier is that when its size exceeds 50 denier, the passability of the fiber through a carding machine is extremely decreased, and it is impossible to form a fiber having such fine interstices as those of a nonwoven fabric.

The porous fiber of the present invention is formed by mixing the polyolefin resin and paraffin wax while they are melted, spinning a fiber from the mixture, stretching the resultant unstretched fiber, heat-treating the fiber, and then removing the paraffin wax by extraction. The unstretched fiber is in a state in which a layer of the paraffin wax is filled between crystallites of the polyolefin resin (polyethylene or polypropylene).

In the above stretched fiber obtained by heat-stretching the unstretched fiber, the intercrystallite intervals are widened, and relatively large, numerous pores are formed in widened intercrystallite intervals when the paraffin wax is extracted after the heat treatment of the stretched fiber. Therefore, the so-obtained porous fiber has a quite special structure.

That is, the lamellae are deformed in zigzag due to the stretching under heat, and then paraffin wax layers formed among these crystallites are removed by extraction. Therefore, the pores in the fiber cross section have a form which is intermittently wide and narrow and continuously extending from the fiber surface to the inside as if they were sponge cucumbers. For this reason, even a fiber having a small diameter has a high void percentage and a large specific surface area. It has been already confirmed that this phenomenon remarkably appears when polyethylene is used.

The adsorption of a substance to be adsorbed occurs in a mechanism in which a liquid at first wets the fiber surface, then the liquid penetrates the pores formed in the main fiber body, and the substance to be adsorbed is adsorbed and held on an internal surface of each pore. As a result, with an increase in the apparent surface area, the adsorption rate increases, and the specific volume decreases. Therefore, an adsorbent material having a constant volume can adsorb and hold a larger amount of a substance to be adsorbed.

When a deodorant substance is attached on a porous fiber having the above form, the deodorant substance spreads on the surface of the main fiber body and the internal surface of each pore to form a thin layer. Therefore, even if the amount of the deodorant substance is small, a greater deodorant effect can be produced.

PREFERRED EMBODIMENTS FOR WORKING THE INVENTION

Figure 1:
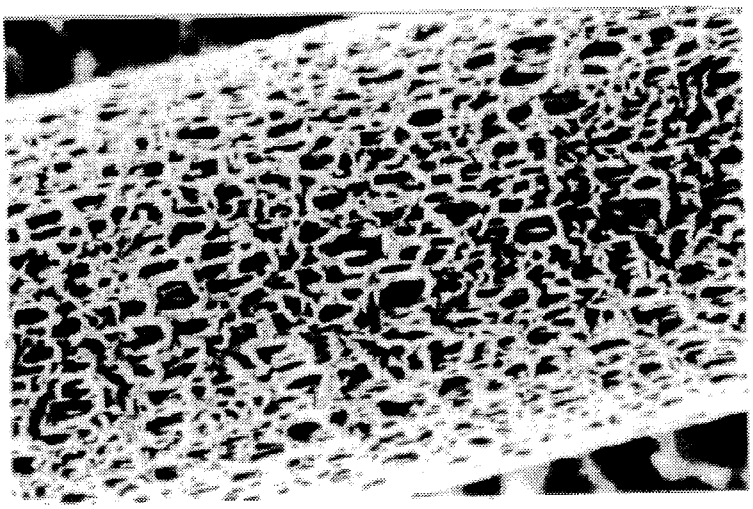
FIG. 1 is an electron scanning microscope photograph of the surface of a porous fiber obtained in Example 1 according to the present invention.

The present invention will be explained hereinafter by reference to Examples. However, the present invention shall not be limited to these Examples alone. In addition, the methods for measurements of physical property values described in Examples are as follows.

Void Percentage

The void percentage is calculated by the following equation on the basis of a diameter denier (D1) calculated from a fiber diameter and a weight denier (D2) obtained from a weight.

$$\text{Void percentage } (\%) = (\text{diameter denier} - \text{weight denier}) / \text{diameter denier} \times 100$$

wherein

D1=cross-sectional area ($cm^2$) of a fiber×9×$10^5$ cm×density ($g/cm^3$), and

D2=weight of a fiber having a length of 9,000 m.

Specific Surface Area

Measured by a nitrogen gas adsorption method provided in JIS Z 8830.

Water Absorption

3 Grams of a fiber was packed with a tea bag, and immersed in methanol for 10 minutes. Then, the fiber in the bag was immersed in water for 60 minutes, centrifugally dehydrated for 3 minutes, and measured for a weight ($W_1$).

The water absorption was calculated based thereon by the following equation.

$$\text{Water absorption } (\%) = (W_1 - 3)/3 \times 100$$

Amount of Adsorbed Surfactant

10 Grams of a fiber was immersed in a 2% $C_8$ alkylphosphate potassium salt aqueous solution (a mixed solution containing 4.5 parts by weight of UN683: supplied by Takemoto Oil and Fats Co. and 95.5 parts by weight of water) for 10 minutes, dehydrated and dried to determine an increment per 10 g of the fiber. The increment was taken as an adsorption amount (g).

Test on Adsorption Properties to Nonylphenol

2 Grams of a fiber cut to 51 mm was placed in 300 ml of an aqueous solution containing 1,000 ppm of nonylphenol, and after predetermined periods of time, the remaining solution was measured for a concentration with a spectrophotometer. Concerning various dyes, a fiber was rendered hydrophilic with methanol, and then 2 g of the fiber was placed in 200 ml of an aqueous solution having a predetermined concentration. After predetermined periods of time, the remaining solution was measured for a concentration with a spectrophotometer.

Apparent Surface Area

The surface area per gram of a fiber was calculated by the following equation.

$$\text{Apparent surface area } (m^2/g) = \{\text{outer diameter } (m) + \text{internal diameter } (m)\} \times \pi \times 9{,}000\ (m) \div D2$$

Specific Volume

The volume per gram of a fiber was calculated by the following equation.

$$\text{Specific volume } (cc/g) = \{\text{outer diameter } (cm)\}^2 \times \pi \div 4 \times 9 \times 10^5\ (cm) \div D2$$

Test on Deodorizing Performance to Ammonia and Trimethylamine

A 300 ml flask was charged with 1,000 ppm of ammonia or 30 ppm of trimethylamine, and 2 g of a fiber was charged thereinto. After predetermined periods of time, the gas concentration in the flask was measured with a Kitagawa method gas detector.

EXAMPLE 1

A raw material prepared by mechanically mixing 100 parts by weight of HDPE having an MFR value of 5.5 g/10 minutes (Hi-zex 2200J, supplied by Mitsui Petrochemical Industries, Ltd) with 100 parts by weight of paraffin wax (145° paraffin, supplied by Nippon Oil Co., Ltd.) was fed to a melt-spinning machine equipped with a screw having a diameter of 25 mm and a nozzle having 0.40 mmø×160 holes and set at 145° C. to 180° C., and an unstretched yarn having a size of 10 denier was obtained at a take-up rate, V1, of 200 m/minute at a yarn spinning draft ratio of 80.

Twelve multifilaments of the above-obtained unstretched yarn were gathered, and stretched with a roller stretching machine under an atmosphere at 110° C. at a total stretch ratio of 3.0 times and at a strain rate of 40%/minute while taking it up. Thereafter, while this fiber was wound around a paper tube, the fiber was heat-treated at a constant length in an oven at 110° C. for 1 hour, and mechanically crimped to impart 15 crimps/inch. The fiber was cut to 51 mm to form a staple fiber, and the staple fiber was immersed in n-hexane at room temperature to extract the paraffin wax.

The so-obtained fiber was non-hollow, and had a void percentage of 45%, a specific surface area of 39 $m^2/g$ and a weight denier of 2.3 denier. This polyethylene-based non-hollow porous fiber showed that the surfactant adsorption amount was 0.78 g and that the water absorption was 105%. This staple fiber was examined on its passability through a carding machine to show that it was excellent. Further, the pore diameter on the fiber surface was 0.5 to 1 μm.

EXAMPLE 2

60 Parts by weight of HDPE having an MFR value of 0.9 g/10 minutes (STAFLEN E809F, supplied by Nippon Petrochemicals Co., Ltd.) and 40 parts by weight of paraffin wax (145° paraffin, supplied by Nippon Oil Co., Ltd.) were mixed together, and a porous fiber was prepared in the same manner as in Example 1 except for a draft ratio of 180% and a stretch ratio of 3.0 times. Table 1 shows the physical property values of the so-obtained fiber.

COMPARATIVE EXAMPLE 1

The same unstretched yarn as that of Example 1 was prepared, and Table 1 shows the physical property values of this unstretched fiber.

COMPARATIVE EXAMPLE 2

A porous fiber was prepared in the same manner as in Example 1 except that the stretch ratio was changed to 4.5 times and that the strain rate was changed to 3,500%/minute. Table 1 shows the physical property values of the so-obtained fiber.

REFERENTIAL EXAMPLES

Referential Example 1 is concerned with a commercially available polyester-based porous fiber (trade name, WELLKY, supplied by Teijin Limited), and Referential Example 2 is concerned with a commercially available acrylic porous fiber (AQUALON, supplied by Kanebo Ltd.).

It is seen from Table 1 that the fiber obtained in Example 2 showed a high water absorption and a high surfactant adsorption, and was excellent as an adsorbent material and a reserve substrate. However, the fiber having a low void percentage, obtained in Comparative Example 1, was not excellent over the conventional polyester-based porous fiber of Referential Example 1 in water absorption. Further, the fiber obtained in Comparative Example 2 had a larger specific surface area than the commercially available fiber of Referential Example 2. However, its surfactant adsorption amount was not so large as expected, and it could not be said to be excellent.

EXAMPLE 3

A raw material prepared by mechanically mixing 100 parts by weight of HDPE having an MFR value of 5.5 g/10 minutes (Hi-zex 2200J, supplied by Mitsui Petrochemical Industries, Ltd) with 100 parts by weight of paraffin wax (145° paraffin, supplied by Nippon Oil Co., Ltd.) was fed to a melt-spinning machine which was an extruder equipped with a screw having a diameter of 25 mm and a nozzle having 30 arc-shaped opening portions formed by closing two places of each circular slit having a thickness of 0.2 mm, an internal diameter of 0.9 mmø and an outer diameter of 1.3 mmø and set at 145° to 180° C., and an unstretched yarn having a size of 29 denier was obtained at a take-up rate, V1, of 200 m/minute at a spinning draft ratio of 170.

Twenty multifilaments were gathered from the above-obtained unstretched yarn, and stretched with a roller stretching machine under an atmosphere at 110° C. at a strain density of 40%/minute at a stretch ratio of 3.0 times while taking it up. Thereafter, while this fiber was wound around a paper tube, the fiber was heat-treated at a constant length in an oven at 110° C. for 1 hour, and mechanically crimped to impart 15 crimps/inch. The fiber was cut to 51 mm to form a staple fiber, and the staple fiber was immersed in hexane at room temperature to extract the paraffin wax.

The above-obtained porous fiber was a hollow fiber having a size of 6.1 denier, an outer diameter of 40 μm and an internal diameter of 11 μm and having a void percentage of 40%, a specific surface area of 36 $m^2/g$, a water absorption of 81% and a surfactant adsorption amount of 0.65 g. Thus, it had sufficient performances.

COMPARATIVE EXAMPLE 3

An unstretched yarn was prepared from the same raw material as that in Example 1 under the same conditions as those in Example 1. The so-obtained unstretched yarn was stretched at a first stretching roller rate of 5 m/minute, at a second stretching roller rate of 15 m/minute, at a stretch ratio of 3 times and at a strain rate of 1,260%. The heat treatment and extraction were carried out in the same manner as in Example 1.

The so-obtained fiber had a void percentage of 36%, whereas the pores were nonuniform and there were observed considerably many places where the pores were collapsed. Thus, the fiber was heavily nonuniform one.

COMPARATIVE EXAMPLES 4 AND 5

In order to study the influence of the stretch ratio, there were examined the void percentages and pore states of the fiber obtained by heat-treating the unstretched yarn of Example 1 at a constant length at 110° C. for 1 hour and then extracting the paraffin wax (Comparative Example 2) and the fiber obtained by adding a stretching at a fourth stage to the stretching conditions in Example 1 so that the total stretch ratio was 5.0 times (Comparative Example 3).

As a result, the former had a void percentage of 20%, and all the pores thereof had narrow and long, cracked form and very small diameters. On the other hand, the latter (Comparative Example 3) had a void percentage of 10%, and some of the pores were found to be collapsed since they were excessively stretched.

COMPARATIVE EXAMPLE 6

An unstretched yarn was obtained from the same raw material as that in Example 1 by means of a nozzle having 80 holes of 0.7 mmø under the conditions of a spinning draft ratio of 256. This unstretched yarn was stretched, heat-treated and subjected to extraction under the same conditions as those in Example 1 to give a porous fiber.

This fiber had a void percentage of about 25%, and its pore diameters were very small. Some of the pores were observed to be collapsed since they were excessively stretched.

TABLE 1

| | Ex-1 | Ex-2 | CEx-1 | CEx-2 | REx-1 | REx-2 |
|---|---|---|---|---|---|---|
| Weight denier | 2.3 | 2.3 | 2.3 | 2.3 | 2.0 | 2.0 |
| Void percentage (%) | 45 | 25 | 16 | 25 | 16 | 14 |
| Specific surface area ($m^2/g$) | 39 | 24 | 25 | 17 | 5.1 | 9.2 |
| Water absorption (%) | 105 | 63.5 | 46 | 64 | 47 | 46 |
| Surfactant adsorption amount (g) | 0.7 | 0.48 | 0.50 | 0.27 | 0.10 | 0.18 |

Ex = Example, CEx = Comparative Example, REx = Referential Example

EXAMPLE 4

A raw material prepared by mechanically mixing 100 parts by weight of polypropylene having an MFR value of 3 g/10 minutes (YK121, supplied by Ube Industries Ltd.) with 100 parts by weight of paraffin wax (145° paraffin, supplied by Nippon Oil Co., Ltd. ) was fed to a melt-spinning machine equipped with a screw having a diameter of 25 mm and a nozzle having 0.4 mmø×160 holes and set at 170° C. to 200° C., and an unstretched yarn having a size of 10 denier was obtained at a take-up rate, V1, of 200 m/minute at a yarn spinning draft ratio of 80.

The above-obtained unstretched yarn was stretched with a roller stretching machine under an atmosphere at 110° C. at a strain rate of 40%/minute and at a stretch ratio of 2.9 times while taking it up.

While this fiber was wound around a paper tube, the fiber was heat-treated at a constant length in an oven at 130° C. for 1 hour, and mechanically crimped to impart 15 crimps/inch. The fiber was cut to 51 mm to form a staple fiber, and the staple; fiber was immersed in hexane at room temperature to extract the paraffin wax.

Figure 2:
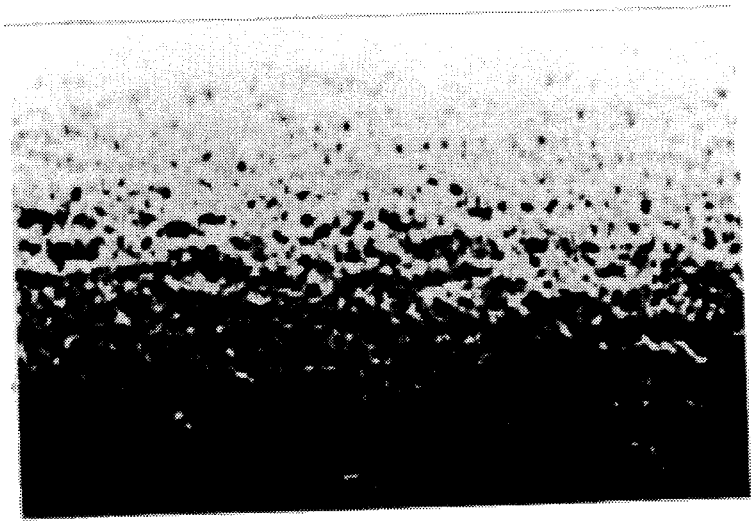
FIG. 2 is an electron scanning microscope photograph of the surface of a porous fiber obtained in Example 4 according to the present invention.

FIG. 2 is an electron microscope photograph of the surface of the porous solid fiber obtained in this Example. Table 3 shows the physical property values of the so-obtained non-hollow porous fiber such as void percentage, etc.

EXAMPLES 5–8 AND COMPARATIVE EXAMPLES 7–10

A plurality of non-hollow porous fibers were prepared in the same manner as in Example 4 except for polypropylene MFRs, raw material compositions, draft ratios and denier of unstretched yarns shown in Table 2. Table 3 shows the denier, void percentage, specific surface area, water absorption and surfactant adsorption amount of each of the so-obtained fibers.

As is clear from the results shown in Table 3, it is seen that all the non-hollow porous fibers obtained in Examples according to the present invention had large void percentages and large specific surface areas and were excellent in the surfactant adsorption amount over the fibers obtained in Comparative Examples.

TABLE 2

| | Polypropylene MFR | Composition of raw material (polypropylene/paraffin wax) | Draft ratio (%) | Unstretched yarn denier |
|---|---|---|---|---|
| Example 4 | 3 | 100/100 | 80 | 10 |
| Example 5 | 3 | 100/100 | 360 | 5 |
| Example 6 | 9 | 100/100 | 80 | 10 |
| Example 7 | 3 | 100/30 | 80 | 10 |
| Example 8 | 3 | 100/300 | 80 | 10 |
| Comparative Example 7 | 3 | 100/100 | 540 | 3.3 Yarn breakage occurred at spinning time |
| Comparative Example 8 | 15 | 100/100 | 80 | Too low in viscosity to spin |
| Comparative Example 9 | 3 | 100/20 | 80 | 10 |
| Comparative Example 10 | 3 | 100/400 | 80 | 10 |

TABLE 3

| | Denier | Void percentage (%) | Specific surface area ($m^2/g$) | Water absorption (%) | Surfactant adsorption amount (g) | Remarks |
|---|---|---|---|---|---|---|
| Example 4 | 2.9 | 26 | 55 | 90 | 1.03 | |
| Example 5 | 1.3 | 22 | 61 | 82 | 1.24 | |
| Example 6 | 2.7 | 25 | 50 | 87 | 0.95 | |
| Example 7 | 3.8 | 20 | 40 | 75 | 0.85 | |
| Example 8 | 1.5 | 28 | 54 | 90 | 0.98 | |
| Comparative Example 7 | 0.8 | 15 | 34 | 55 | 0.60 | small pore diameter |
| Comparative Example 8 | — | — | — | — | — | |
| Comparative Example 8 | 4.3 | 16 | 28 | 56 | 0.50 | |
| Comparative Example 8 | 1.0 | 24 | 65 | 85 | 1.24 | too low fiber strength |

EXAMPLE 9

A raw material prepared by mechanically mixing 100 parts by weight of polypropylene having an MFR value of 3 g/10 minutes (YK121, supplied by Ube Industries, Ltd) with 100 parts by weight of paraffin wax (145° paraffin, supplied by Nippon Oil Co., Ltd. ) was fed to a melt-spinning machine which was an extruder equipped with a screw having a diameter of 25 mm and a nozzle having 30 arc-shaped opening portions formed by closing two places of each circular slit having a thickness of 0.2 mm, an internal diameter of 0.9 mmø and an outer diameter of 1.3 mmø and set at 170° C. to 200° C., and an unstretched yarn having a size of 29 denier was obtained at a take-up rate, V1, of 200 m/minute at a spinning draft ratio of 170.

The above-obtained unstretched yarn was stretched with a roller stretching machine under an atmosphere at 110° C. at a strain ratio of 40%/minute at a stretch ratio of 3.0 times while taking it up. While this fiber was wound around a paper tube, the fiber was heat-treated at a constant length in an oven at 130° C. for 1 hour, and mechanically crimped to impart 15 crimps/inch. The fiber was cut to 51 mm to form a staple fiber, and the staple fiber was immersed in n-hexane at room temperature to extract the paraffin wax.

The above-obtained porous fiber was a hollow fiber having an outer diameter of 39 μm and an internal diameter of 12 μm and having a void percentage of 23%, a specific surface area of 50 $m^2/g$, a water absorption of 70% and a surfactant adsorption amount of 0.96 g. Thus, it had sufficient performances.

Table 4 below shows the results of the adsorption test of the fibers obtained in the above Examples 1 and 4 to nonylphenol which is one of nonionic surfactants. Further, the adsorption test of these adsorption fibers to various dyes was carried out, and the results are shown in Table 5.

In addition, Comparative Examples referred to in Tables 4 and 5 are as follows.

COMPARATIVE EXAMPLE 11

A commercially available polyethylene-based hollow porous fiber (supplied by Mitsubishi Rayon Co., Ltd.) was tested.

COMPARATIVE EXAMPLE 12

A commercially available polypropylene-based hollow porous fiber (supplied by Ube Industries, Ltd.) was tested.

COMPARATIVE EXAMPLE 13

A general polypropylene-based monofilament fiber having a size of 2 denier was tested.

As is clear from the adsorption performance test results shown in Table 4, the adsorption fibers according to the present invention have large apparent surface areas and small specific volumes and therefore exhibit high adsorption rates and greater adsorption amounts per unit volume. Further, Table 5 shows that the adsorption fibers of these Examples according to the present invention are effective for various dyes.

TABLE 4

| | Example 1 | Example 2 | Comparative Example 11 | Comparative Example 12 |
|---|---|---|---|---|
| Outer diameter (μm) | 24 | 24 | 380 | 400 |
| Internal diameter (μm) | 0 | 0 | 260 | 300 |
| Weight denier | 2.3 | 2.9 | 210 | 112 |
| Void percentage (%) | 45 | 26 | 60 | 75 |
| Specific surface area ($m^2/g$) | 39 | 55 | 40 | 50 |
| Apparent | 0.295 | 0.234 | 0.086 | 0.177 |

TABLE 4-continued

| | | Example 1 | Example 2 | Comparative Example 11 | Comparative Example 12 |
|---|---|---|---|---|---|
| surface area ($m^2$) | | | | | |
| Specific volume (cc/g) | | 1.77 | 1.40 | 4.86 | 10.09 |
| Adsorption performance to nonylphenol (equal weight) 2 g | 0 min. | 1,000 PPM | 1,000 PPM | 1,000 PPM | 1,000 PPM |
| | 1 min. | 62 | 43 | 95 | 90 |
| | 2 min. | 55 | 34 | 87 | 80 |
| | 5 min. | 50 | 20 | 70 | 64 |
| | 10 min. | 48 | 17 | 49 | 40 |
| Adsorption performance to nonylphenol (equal volume) 3.54 cc | 0 min. | 1,000 PPM | 1,000 PPM | 1,000 PPM | 1,000 PPM |
| | 1 min. | 62 | 33 | 500 | 850 |
| | 2 min. | 55 | 28 | 480 | 800 |
| | 5 min. | 50 | 14 | 290 | 650 |
| | 10 min. | 48 | 10 | 270 | 440 |

TABLE 5

| | | Solution Concentration (ppm) | | |
|---|---|---|---|---|
| | | 0 min. | 10 min | 60 min. |
| Direct Yellow 12 | Ex. 1 | 100.0 | 20.0 | 1.3 |
| (direct cotton dye) | CEx. 13 | 100.0 | 100.0 | 99.0 |
| Methyl Violet BB | Ex. 1 | 50.0 | 2.5 | 1.2 |
| (direct cotton dye) | CEx. 13 | 50.0 | 50.0 | 49.0 |
| Methylene Blue | Ex. 1 | 50.0 | 7.1 | 4.9 |
| (basic dye) | CEx. 13 | 50.0 | 50.0 | 50.0 |
| Malachite Green | Ex. 1 | 50.0 | 2.1 | 0.6 |
| (basic dye) | CEx. 13 | 50.0 | 49.0 | 49.0 |
| Suminol Fast Red B | Ex. 1 | 50.0 | 4.9 | 1.1 |
| (acidic dye) | CEx. 13 | 50.0 | 50.0 | 50.0 |
| Simikaron Red S-GG | Ex. 1 | 50.0 | 49.0 | 45.0 |
| (disperse dye) | CEx. 13 | 50.0 | 50.0 | 50.0 |

Ex. = Example, CEx = Comparative Example

EXAMPLE 10

2 Grams of the polyethylene-based porous fiber obtained in the above Example 1 was rendered hydrophilic with 200 ml of ethanol, and then it was placed in a 500 ml beaker containing 200 ml of a 1.5% ethanol solution of a *Quercus stenophylla* extract (trade name, OAKLEAN EX, supplied by Taiyo Koryo K.K.) as a deodorant substance which was an extract of a fagaceous plant, and allowed to stand for 3 minutes. Then, the fiber was centrifugally dehydrated for 3 minutes and dried in an oven set at 55° C. for 1 hour to give a polyethylene-based deodorant porous fiber in which the outer surface of the porous fiber and the internal surfaces of the pores were coated with the *Quercus stenophylla* extract.

The so-obtained deodorant fiber had a *Quercus stenophylla* extract adherence amount of 0.7%. Table 6 shows the results of deodorizing performance test of the obtained deodorant fiber.

EXAMPLE 11

2 Grams of the polypropylene-based porous fiber obtained in the above Example 4 was rendered hydrophilic with 200 ml of ethanol, and then it was placed in a 500 ml beaker containing 200 ml of a 1.0% ethanol solution of a *Quercus stenophylla* extract (trade name, OAKLEAN EX, supplied by Taiyo Koryo K.K.) as a deodorant substance which was an extract of a fagaceous plant, and allowed to stand for 3 minutes. Then, the fiber was centrifugally dehydrated for 3 minutes and dried in an oven set at 55° C. for 1 hour to give a polypropylene-based deodorant porous fiber in which the outer surface of the porous fiber and the internal surfaces of the pores were coated with the *Quercus stenophylla* extract.

The so-obtained deodorant fiber had a *Quercus stenophylla* extract adherence amount of 0.4%. Table 6 shows the results of deodorizing performance test of the obtained deodorant fiber.

EXAMPLE 12

A porous fiber obtained in the same manner as in Example 10 was treated in the same manner as above to allow a *Quercus stenophylla* extract to adhere thereto, whereby a deodorant fiber having an adjusted adherence amount of 0.4% was obtained. Table 6 also shows the deodorizing performance of this deodorant fiber.

COMPARATIVE EXAMPLE 14

A general polypropylene-based fiber having a nearly smooth surface and a size of 2 denier was treated in the same manner as above to allow a *Quercus stenophylla* extract to adhere thereto. The adherence amount of the *Quercus stenophylla* extract was 0.7% as it was in Example 1. Table 6 also shows the deodorizing performance of this deodorant fiber.

As is clear from the results of the deodorizing performance test, the deodorant fiber according to the present invention can remove an offensive odor-emitting substance for a short period of time. The reason therefor is as below. The pores of the porous fiber of the present invention have a form which is intermittently wide and narrow and extending from the surface to the inside as if they were hollow portions of a sponge cucumber, and therefore, the porous fiber has a high void percentage and a large specific surface area.

When a deodorant substance is allowed to adhere to a porous fiber having such a form, the deodorant substance spreads over the surface of the main fiber body and the internal surfaces of the pores to form thin layers. Meanwhile, even if the same amount of a deodorant substance is allowed to adhere to the fiber shown in Comparative Example, the deodorant substance adheres to form a thick layer since the surface area is limited, and in an initial deodorizing performance, tile deodorant substance inside does not effectively function. Therefore, the performance of removing an offensive odor-emitting substance is inferior.

In contrast, it is considered that the deodorant fiber of the present invention produces a high deodorizing effect even if the amount of a deodorant is small, since the deodorant substance adheres widely in a thin film form.

The above Examples have used a *Quercus stenophylla* extract as an example, while the working of the present invention shall not be limited thereto. For example, plant extract oils such as a wild thyme extract may be used. And, in fields where no high deodorizing performance is required, a surfactant used as a surface-treating agent for a fiber will do to obtain a deodorizing effect. Further, the amount of a deodorant substance to be allowed to adhere to the deodorant fiber of the present invention is practically in the range of 0.1 to 10% by weight.

TABLE 6

| | | Example 10 | Example 11 | Example 12 | Comparative Example 14 |
|---|---|---|---|---|---|
| Material | | PE | PP | PE | PP |
| weight denier | | 2.3 | 2.9 | 2.3 | 2.0 |
| Voikd percentage (%) | | 45 | 26 | 45 | 0 |
| Specific surface area ($m^2/g$) | | 39 | 55 | 39 | 0.25 |
| OAKLEAN adherence amount (%) | | 0.7 | 0.4 | 0.4 | 0.7 |
| Ammonia | 0 min. | 1,000 PPM | 1,000 PPM | 1,000 PPM | 1,000 PPM |
| | 5 min. | 70 | 200 | 200 | 460 |
| | 10 min. | 30 | 180 | 190 | 250 |
| | 60 min. | 10 | 100 | 110 | 190 |
| Trimethylamine | 0 min. | 30 PPM | 30 PPM | 30 PPM | 30 PPM |
| | 5 min. | 11 | 14 | 12 | 22 |
| | 10 min. | 4 | 6 | 5 | 12 |
| | 60 min. | >0.5 | >0.5 | >0.5 | 10 |

INDUSTRIAL UTILIZABILITY

As specified above, the porous fiber of the present invention is non-hollow or hollow, and it shows a high adsorption amount to a variety of adsorbents and excellent chemical resistance. Therefore, it can be used as a filter for the removal of a substance dissolved or dispersed in a liquid or as a fiber to which a deodorant substance is allowed to adhere to remove a foreign odor.

We claim:

1. A porous fiber comprising a main fiber body formed of a high-density polyethylene having a melt flow rate of 0.3 to 20 g/10 minutes and numerous pores formed by mixing the above high-density polyethylene with a paraffin wax while they are melted, melt-spinning a fiber therefrom with an extruder at a draft ratio of not more than 200, stretching the fiber, heat-treating the fiber and then removing the above paraffin wax, the main fiber body having a specific surface area of not less than 20 $m^2/g$, the pores having a proportion thereof to the main fiber body being not less than 20%, the main fiber body having a size of not more than 50 denier.

2. A porous fiber comprising a main fiber body formed of a polypropylene-based resin having a melt flow rate of 0.5 to 9 g/10 minutes and numerous pores formed by mixing the above polypropylene-based resin with a paraffin wax while they are melted, melt-spinning a fiber therefrom with an extruder at a draft ratio of not more than 400, stretching the fiber, heat-treating the fiber and then removing the above paraffin wax, the main fiber body having a specific surface area of not less than 20 $m^2/g$, the pores having a proportion thereof to the main fiber body being not less than 20%, the main fiber body having a size of not more than 50 denier.

3. A porous fiber according to claim 1 or 2, wherein a deodorant substance is allowed to adhere to internal surfaces of the pores.

4. A porous fiber according to claim 3, wherein the deodorant substance is a plant extract liquid selected from a *Quercus stenophylla* extract, a wild thyme extract, etc.

5. A porous fiber according to claim 3, wherein the deodorant substance is a surfactant.

* * * * *